US005791574A

United States Patent [19]

Hastings

[11] Patent Number: 5,791,574

[45] Date of Patent: Aug. 11, 1998

[54] YARN BOBBIN WITH IMPROVED SNAGGER

[75] Inventor: William B. Hastings, Cantonment, Fla.

[73] Assignee: Solutia, Inc., St. Louis, Mo.

[21] Appl. No.: 819,098

[22] Filed: Mar. 18, 1997

Related U.S. Application Data

[60] Provisional application No. 60/013,542 Mar. 18, 1996.

[51] Int. Cl.[6] ..... B65H 54/00; B65H 75/00; B65H 75/28

[52] U.S. Cl. ..... 242/18 PW; 242/118.32; 242/125.1

[58] Field of Search ..... 242/125.1, 18 PW, 242/118.32

[56] References Cited

U.S. PATENT DOCUMENTS

| | | | |
|---|---|---|---|
| 182,071 | 9/1876 | Hill | 242/125.1 |
| 2,262,665 | 11/1941 | Cavanaugh | 242/125.1 |
| 2,945,638 | 7/1960 | Crawford et al. | 242/118.32 |
| 2,987,267 | 6/1961 | Hayes et al. | 242/125.1 |
| 3,051,411 | 8/1962 | Atwood et al. | 242/125.1 |
| 3,103,305 | 9/1963 | Heatherly . | |
| 3,158,335 | 11/1964 | Deussen | 242/172 |
| 3,284,023 | 11/1966 | Sowell | 242/125.1 |
| 3,326,494 | 6/1967 | Hartley, Jr. | 242/125.1 |
| 3,368,774 | 2/1968 | Nettles . | |
| 3,420,467 | 1/1969 | Bell . | |
| 3,450,370 | 6/1969 | Hawkins | 242/118.32 |
| 3,520,490 | 7/1970 | Williams | 242/118.32 |
| 3,577,271 | 5/1971 | Bliven et al. . | |
| 3,625,451 | 12/1971 | Anderson | 242/125.1 |
| 3,717,291 | 2/1973 | Adams et al. . | |
| 3,746,275 | 7/1973 | Whisnant | 242/118.32 |
| 3,756,530 | 9/1973 | Ito et al. | 242/118.2 |
| 3,767,129 | 10/1973 | Sobel | 242/18 R |
| 3,794,260 | 2/1974 | Sowell | 242/125.1 |
| 3,838,828 | 10/1974 | Hautemont | 242/18 DD |
| 3,986,680 | 10/1976 | Cardell | 242/125.1 |
| 4,050,645 | 9/1977 | Burchette, Jr. et al. | 242/125.1 |
| 4,101,086 | 7/1978 | Thomas, Jr. | 242/18 PW |
| 4,313,579 | 2/1982 | Zuber et al. | 242/125.1 X |
| 4,351,491 | 9/1982 | Hill, Jr. | 242/18 PW |
| 4,371,130 | 2/1983 | Case | 242/125.1 |
| 4,413,791 | 11/1983 | Kawaguchi et al. | 242/18 PW X |
| 4,760,976 | 8/1988 | Burchette, Jr. | 242/125.1 X |
| 4,852,823 | 8/1989 | Adams et al. | 242/18 PW X |
| 5,211,354 | 5/1993 | Rummage | 242/125.1 |
| 5,248,111 | 9/1993 | Teckentrup et al. | 242/125.1 |
| 5,328,121 | 7/1994 | Rummage | 242/125.1 |

*Primary Examiner*—Michael Mansen
*Attorney, Agent, or Firm*—Arnold, White & Durkee

[57] ABSTRACT

An improved yarn bobbin and yarn snagger including a core, a groove formed in the wall of the core and a yarn-engaging insert housed within the groove. The width of the groove opening is narrower than the width of the groove base while the width of the top portion of the insert is similarly narrower than its base portion. The insert preferably includes locking arms which extend from the sides of the insert and which terminate at adjacent ends which are equidistant from the insert base.

13 Claims, 3 Drawing Sheets

YARN BOBBIN WITH IMPROVED SNAGGER

This application claims the benefit of U.S. Provisional Application No. 60/013,542, filed Mar. 18, 1996.

BACKGROUND OF THE INVENTION

1. Field of the Invention

The present invention is directed to a yarn bobbin with an improved snagger for engaging yarn to initiate winding of the yarn onto the bobbin. More specifically, the present invention is directed to a yarn bobbin including a groove formed in the bobbin core and a yarn-engaging insert housed therein.

2. Description of the Prior Art

In conventional yarn manufacturing processes, finished yarn is customarily wound onto carriers for storage and shipment. These carriers, called bobbins, are typically hollow forms which are cylindrical or conical in shape. The standard yarn winding process includes frictionally engaging or snagging the yarn end from an upstream source with a rotating bobbin so as to connect the yarn end to the rotating bobbin and cause winding of the yarn supply onto the bobbin. Should the rotating bobbin fail to properly snag the yarn, the yarn will either not wind onto the bobbin or the resulting yarn "package" will be improperly wound and therefore unsuitable for shipment. It is therefore readily apparent that proper initiation of the winding process is an essential step in yarn manufacturing.

It is known in the prior art to impart yarn bobbins with certain features which facilitate this crucial frictional engagement step. For example, the textile core or bobbin disclosed in U.S. Pat. No. 3,284,023 includes a V-shaped notch or groove and a protuberance formed in its exterior surface to form a yarn trap. More recently, a textile core including a V-shaped start-up groove with a roughened sidewall surface formed therein was disclosed in U.S. Pat. No. 5,211,354. Bobbins such as those referenced above have the serious drawback of the snagging means being an integral part of the bobbin. With such bobbin constructions, failure of the snagging means necessarily results in wasteful and inefficient disposal of an otherwise useful bobbin.

Separate snagging devices for mounting on yarn bobbins are disclosed, for example, in U.S. Pat. No. 3,625,451. More specifically, this patent discloses a yarn carrier including a V-shaped groove in its surface and a yarn catch insert mounted within the groove. This type of construction has the disadvantage of insert slippage and loss over time, especially in bobbin constructions where the insert securing means (barbs) fail to penetrate the core material. This problem is especially prevalent in reusable or permanent bobbin constructions which utilize harder materials such as resin/fabric composites. Further, the complex construction of the insert disclosed in the '451 patent can raise the need for expensive and time-consuming process steps in manufacture.

Despite these advances in the art, a need therefore remains for a long-lasting and inexpensive yarn snagger.

BRIEF SUMMARY OF THE INVENTION

The present invention satisfies this need and achieves the additional advantages discussed in more detail below by providing an improved yarn bobbin and yarn snagger therefor. In brief, the bobbin of the present invention includes a core, a groove formed in the wall of the core and a yarn-engaging insert housed within the groove. The width of the groove opening is narrower than the width of the groove base while the width of the top portion of the insert is similarly narrower than its base portion. The insert preferably includes locking arms which extend from the sides of the insert and which terminate at adjacent ends which are equidistant from the insert base.

The bobbin of the present invention successfully and consistently engages incoming yarn ends without breakage during the yarn winding processes regardless of whether the incoming yarn is traveling co-current or counter-current to bobbin rotation. Further, the improved bobbin resists wear over time and minimizes yarn breaking and damaging during the winding process.

BRIEF DESCRIPTION OF THE DRAWINGS

These and other features of the present invention are more fully set forth in the following description of illustrative embodiments of the invention. The description is presented with reference to the accompanying drawings in which.

DETAILED DESCRIPTION OF THE ILLUSTRATIVE EMBODIMENTS

Figure 1:
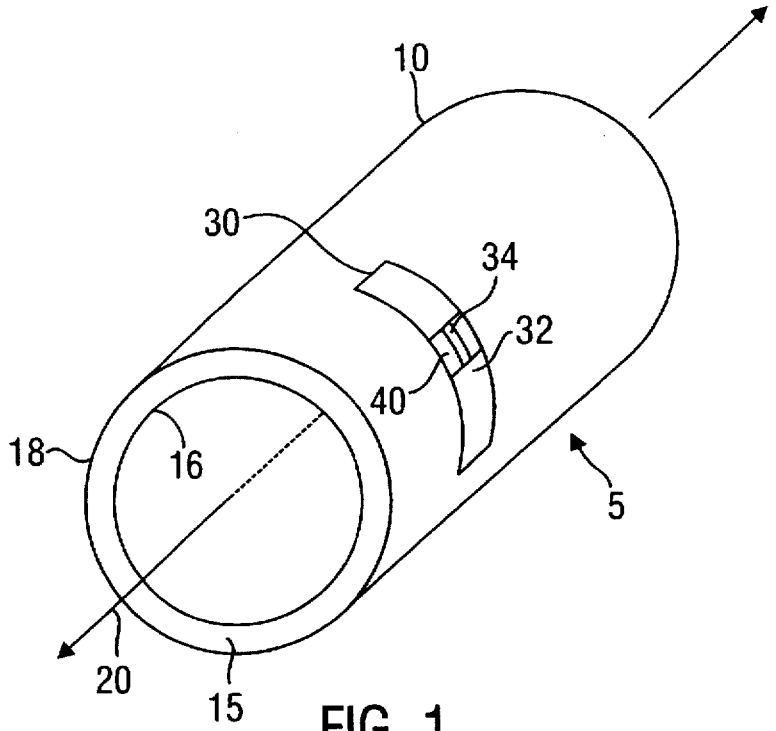
FIG. 1 is a perspective view of the bobbin of the present invention.
Figure 2:
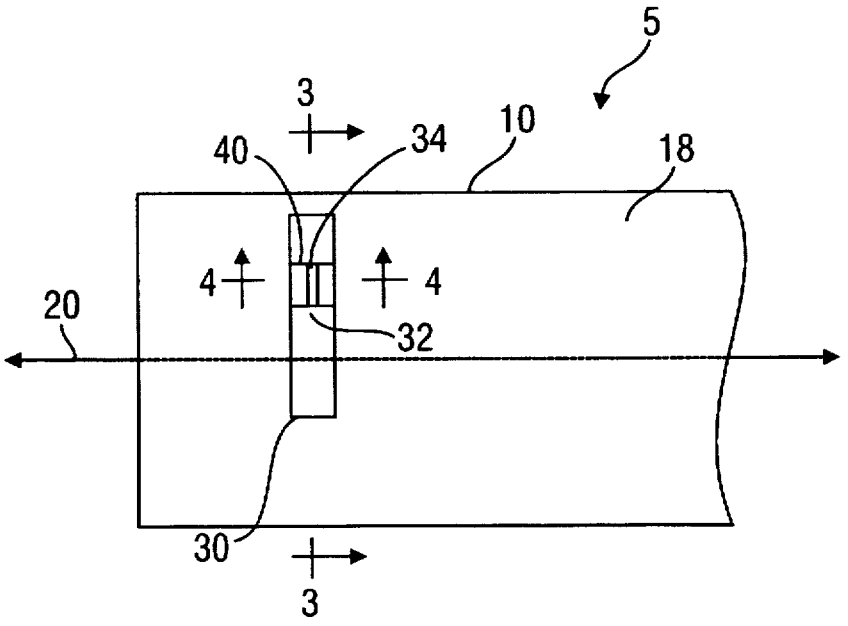
FIG. 2 is a side plan view of the bobbin of FIG. 1.

As shown in FIGS. 1–4, the bobbin 5 of the present invention includes a core 10 having a curved wall 15 with an inner surface 16 and an outer surface 18. The core 10 is most preferably cylindrical or conical in shape with the outer surface 18 defining the circumference 19 of the wall 15. The wall 15 is preferably circular in cross-section as taken perpendicular to the longitudinal axis 20 of the core 10. The wall 15 further has a thickness 25 of preferably 5 to 15 mm and is most preferably formed from a material having a hardness of about 90 as measured by a conventional Durometer on the "M" scale. This hardness facilitates re-use of the core 10 after yarn has been removed therefrom. Preferred materials for the core include paper, metal and resin-based composites. Preferred materials as used commercially in bobbins manufactured by Spaulding Composites Co. under the name SPAULDITE® are phenolic resin-impregnated fabric and phenolic resin-impregnated paper. It is to be understood, however, that other materials conventionally used for bobbin manufacture may be utilized in manufacturing the bobbin of the present invention.

A groove 30 is formed in the outer surface 18 and extends at least partially through the wall thickness 25 and at least partially around the wall 15 of the core 10. The depth of the groove 30 may vary along its length. In the preferred embodiment where the core 10 is cylindrical or conical in shape, the groove 30 preferably extends from about 120° to about 180° around the circumference 19 of the wall 15. The groove 30 has a yarn-engaging portion 32 which includes an opening 34 along the outer surface 18 and a bottom 35. An important feature of the present invention is that the width of the opening 34 of the yarn-engaging portion 32 is narrower than the bottom 35.

Figure 3:
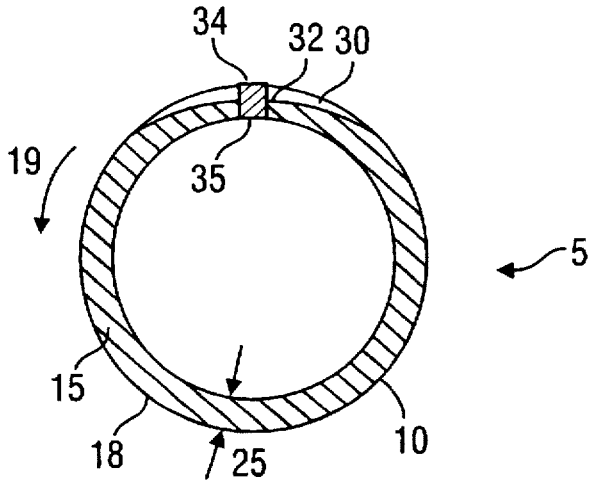
FIG. 3 is a cross-sectional view of the bobbin of the present invention taken along line 3—3 of FIG. 2.
Figure 4:
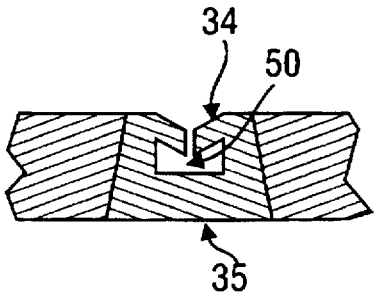
FIG. 4 is an enlarged cross-sectional view of the groove of the present invention taken along line 4—4 of FIG. 2.
Figure 5:
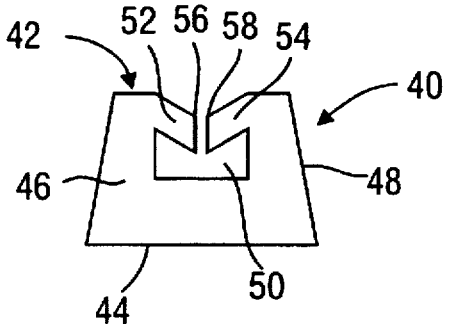
FIG. 5 is a front plan view of the yarn snagger of the present invention.
Figure 6:
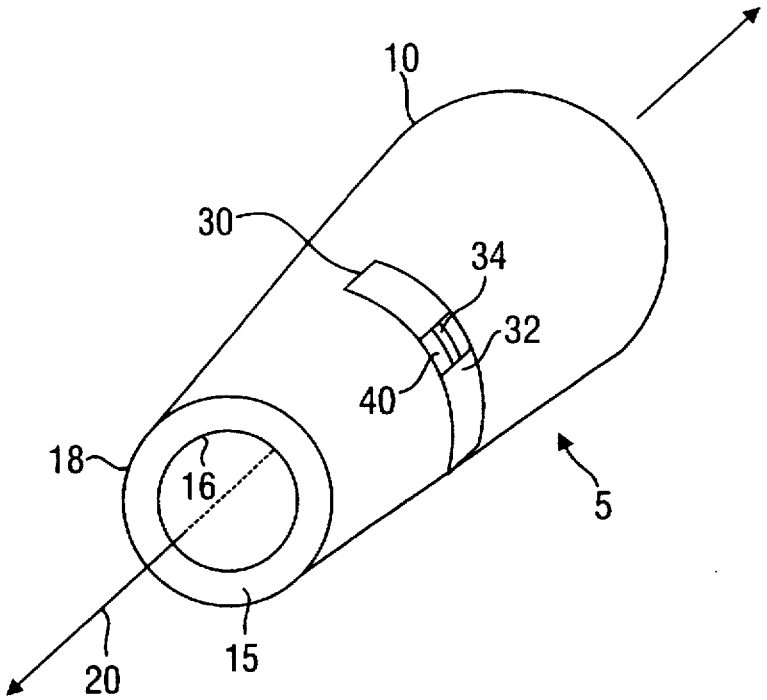
FIG. 6 is a perspective view of a conical bobbin embodiment of the present invention.
Figure 7:
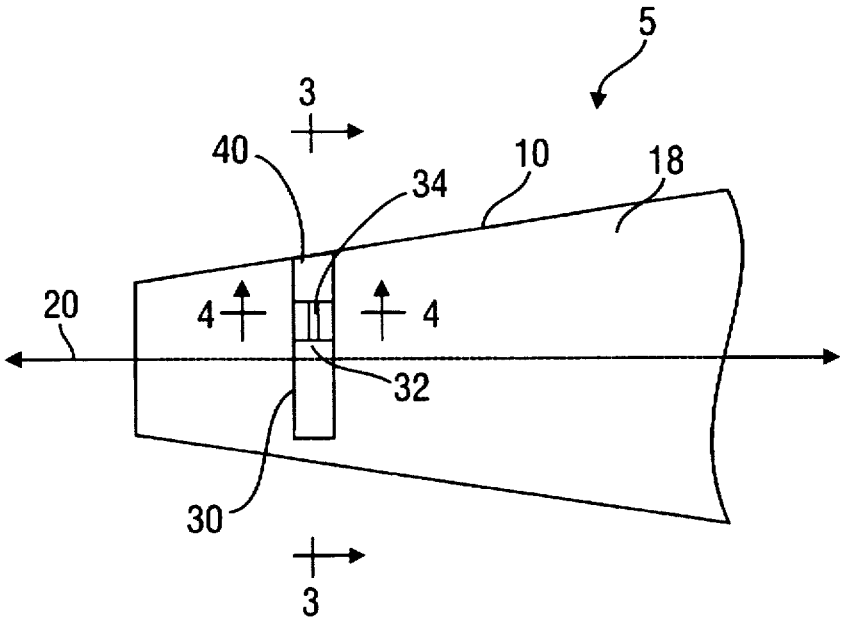
FIG. 7 is a side plan view of the conical bobbin embodiment of FIG. 6.

As shown in FIGS. 3–5, a yarn-engaging insert 40, or snagger, is housed within the yarn-engaging portion 32 of the groove 30. The insert 40 includes a top 42, a flat base 44 and two sides 46 and 48 which all together define a yarn holding space 50 for frictionally engaging and holding yarn (not shown). More preferably, the top 42 of the insert 40 includes a pair of locking arms 52 and 54 which extend from sides 46 and 48 and which terminate at adjacent ends 56 and 58. Most preferably, the ends 56 and 58 are equidistant from the base 44 of the insert 40.

As noted above, the width of the opening 34 of the yarn-engaging portion 32 is narrower than the bottom 35. Correspondingly, the width of the top 42 of the insert 40 housed within the yarn-engaging portion 32 of the groove 30 is narrower than the width of the base 44 of the insert 40. This width relationship promotes maintenance of the insert 40 firmly in the groove 30 during the exceedingly high tensional and centrifugal forces exerted on the insert 40 during yarn snagging. It is also in contrast to prior art "V-shaped" bobbin grooves which are wider at the top than the bottom and could thereby promote slippage and accidental dislodgment of the yarn.

The insert 40 may be fabricated from any conventional material, for example metals, plastics and the like. A particularly suitable material for use in fabricating the insert is steel.

The methods utilized in manufacturing the bobbin of the present invention may be any of the conventional methods known to one of ordinary skill in the art. The choice of core fabrication method depends upon the selection of the material utilized for the core. In the preferred embodiment wherein the core is formed from a material having a hardness value of about 90 as measured with a conventional Durometer on the "M" scale such that the bobbin is suitable for re-use, the core formation process includes winding layers of fabric or paper around a cylinder and impregnating the layers with a phenolic resin binder. Bobbins formed by such processes are commercially available from Spaulding Composites Co. under the name SPAULDITE®.

The groove, including the yarn-engaging portion, may be formed by conventional methods, for example cutting the groove into the core thickness with a knife or similar device typically in conjunction with rotating the bobbin. In the embodiment where the core is molded, the groove may be molded directly into the core.

The insert may also be formed by known processes which are selected based on the material utilized to form the insert. For example, metal inserts may be formed by conventional stamping or machining processes. Plastic inserts may be formed by conventional molding processes, including injection molding.

The insert is preferably installed into the yarn-engaging portion of the groove by press fitting the insert into the groove. Preferably, a suitable adhesive is used to further secure the insert in the groove.

The bobbin of the present invention is particularly useful in the conventional winding and packaging of yarns for shipment and subsequent use in textile manufacture. In such processes, a moving yarn line is gathered up onto an empty bobbin rotating about its longitudinal axis, by bringing the yarn line into tangential contact with outer surface of the rotating bobbin. The yarn line frictionally engages the snagger of the rotating bobbin and thus the bobbin catches, grips or snags the yarn line initiating the windup process. The windup process forms a spool of yarn for shipment and subsequent use in textile manufacture. The present invention provides a bobbin useful for such processes which performs the above functions while resisting wear and avoiding yarn damage.

While the detailed description of the present invention is set forth above in detail, it is to be understood that many variations and modifications which do not depart from the spirit and scope of the present invention may be made. For example, the bobbin of the present invention may be utilized in winding processes for a variety of natural and synthetic yarns in a wide assortment of deniers. Further, the materials used in fabricating the components of the bobbin of the present invention as well as their method of assembly may be chosen and modified to meet the specific requirements of the bobbin's intended purpose.

What is claimed is:

1. A yarn bobbin comprising:

a) a core including a longitudinal axis and a curved wall, said wall having an outer surface, an inner surface and a thickness;

b) a groove formed in said outer surface and extending at least partially through said thickness and at least partially around said wall, said groove including a yarn-engaging portion having an opening and a bottom, said opening being located along said outer surface of said wall and being narrower than said bottom; and c) a yarn-engaging insert housed within said yarn-engaging portion of said groove, said insert including a top and base, said top being narrower than said base and further including sides which together with said top and said base, define a yarn holding space.

2. The bobbin of claim 1 wherein said wall is circular in cross-section taken perpendicular to said longitudinal axis of said core.

3. The bobbin of claim 2 wherein said groove extends from about 120° to about 180° around the circumference of said wall.

4. The bobbin of claim 2 wherein said core is conical in shape.

5. The bobbin of claim 2 wherein said core is cylindrical in shape.

6. The bobbin of claim 1 wherein said top includes a pair of locking arms extending from said sides and terminating at adjacent ends.

7. The bobbin of claim 6 wherein the ends of said locking arms are equidistant from said base of said insert.

8. The bobbin of claim 1, wherein said core is formed from a material having a hardness of about 90 as measured by a conventional Durometer on the "M" scale.

9. The bobbin of claim 1, wherein said core is made of materials selected from paper, fabric, metal, or resin based composites.

10. A bobbin comprising:

a) a core including a longitudinal axis and a curved wall, said wall having an outer surface, an inner surface and a thickness;

b) a groove formed in said outer surface and extending at least partially through said thickness and from about 120° to about 180° around the circumference of said wall, said groove including a yarn-engaging portion having an opening and a bottom, said opening being located along said outer surface of said wall and being narrower than said bottom; and c) a yarn-engaging insert housed within said yarn-engaging portion of said groove, said insert including a top, a base and sides, said top being narrower than said base, and wherein said sides together with said top and said base define a yarn holding space and wherein said top includes a pair of locking arms extending from said sides and terminating at adjacent ends such that the ends of said locking arms are equidistant from said base of said insert.

11. A method of winding and packaging yarn for shipment and subsequent use in textile manufacture on a bobbin, said bobbin having a longitudinal axis, so as to form a spool of yarn, comprising:

a) rotating said bobbin about said bobbin's longitudinal axis, said bobbin comprising: a core including a curved wall, said curved wall coaxially encircling and defining the longitudinal axis of said bobbin, said curved wall having an outer surface, an inner surface and a thickness; a groove formed in said outer surface and extending at least partially through said thickness and at least partially around said wall, said groove including a yarn-engaging portion having an opening and a bottom, said opening being located along said outer surface of said wall and being narrower than said bottom; and, a yarn-engaging insert housed within said yarn-engaging portion of said groove, said insert including a top and base, said top being narrower than said base and further including sides which together with said top and said base, define a yarn holding space;

b) bringing the yarn line into tangential contact with said outer surface of said rotating bobbin so that said yarn line becomes frictionally engaged by said yarn engaging insert; and, c) gathering said yarn line on said rotating bobbin so as to form said spool of yarn.

12. The method of claim 11 wherein said top of said insert includes a pair of locking arms extending from said sides and terminating at adjacent ends the ends of said locking arms are equidistant from said base of said insert.

13. The method of claim 12 wherein said groove extends from about 120° to about 180° around the circumference of said wall.

* * * * *